US005221111A

United States Patent [19]

Younger

[11] Patent Number: 5,221,111

[45] Date of Patent: Jun. 22, 1993

[54] SKATEBOARD ACCESSORY TO ASSIST IN AIRBORNE MANEUVERS

[76] Inventor: Roger L. Younger, 10 N.E. 162nd Ave. #6, Portland, Oreg. 97230

[21] Appl. No.: 854,484

[22] Filed: Mar. 20, 1992

Related U.S. Application Data

[63] Continuation-in-part of Ser. No. 665,421, Mar. 6, 1991, abandoned.

[51] Int. Cl.[5] ..... A63C 7/14

[52] U.S. Cl. ..... 280/809; 16/114 R; 24/607; 224/901; 280/87.042; 403/328

[58] Field of Search ..... 224/252, 269, 271, 272, 224/901; 403/324, 328, DIG. 4, DIG. 6; 280/637, 87.042, 809; 24/306, 442, 607; 16/114 R; 81/177.85

[56] References Cited

U.S. PATENT DOCUMENTS

| | | | |
|---|---|---|---|
| D. 218,628 | 9/1970 | Gonzalez | 280/87.042 X |
| 3,140,522 | 7/1964 | Prout | 16/114 R X |
| 3,430,305 | 3/1969 | Geffner | 24/607 X |
| 4,129,313 | 12/1978 | Benson | 280/14.2 |
| 4,144,794 | 3/1979 | Silverman et al. | 224/257 X |
| 4,179,134 | 12/1979 | Atkinson | 280/87.042 |
| 4,198,080 | 4/1980 | Carpenter | 403/DIG. 6 X |
| 4,289,325 | 9/1981 | Whitacre | 280/87.042 |
| 4,403,366 | 9/1983 | Lucke | 224/901 X |
| 4,462,728 | 7/1984 | Sturgis | 16/114 R X |
| 4,537,100 | 8/1985 | Palm | 81/177.85 |
| 4,663,796 | 5/1987 | Helling et al. | 81/177.85 X |
| 4,690,316 | 9/1987 | Peterson | 224/901 X |
| 4,728,123 | 3/1988 | Kassal et al. | 224/220 X |
| 4,732,400 | 3/1988 | Santini | 280/87.042 |
| 4,811,971 | 3/1989 | Phillips | 280/87.042 X |
| 4,830,244 | 5/1989 | Brannon | 224/269 X |
| 4,886,297 | 12/1989 | Levine | 16/114 R X |
| 4,887,825 | 12/1989 | Allen et al. | 280/87.042 |
| 5,020,827 | 6/1991 | Murdoch | 280/87.042 X |
| 5,026,088 | 6/1991 | Stuart | 280/14.2 |
| 5,090,716 | 2/1992 | Borden | 280/87.042 |

*Primary Examiner*—Margaret A. Focarino
*Assistant Examiner*—Michael Mar
*Attorney, Agent, or Firm*—Dellett, Smith-Hill and Walters

[57] ABSTRACT

A skateboard accessory for attaching a stretchable handle member or one or more of a variety of such handles to a point near the center of the skateboard in a readily disconnectable manner that does not protrude from or take up space on the surface of the board. In a preferred embodiment, two thin discs of lightweight material connect together through a hole near the center of the skateboard and present one mating part of a quick release snap-in connector to the upper side of the board. A second mating part of the quick release snap-in connector having the opposite gender is attached to a stretchable strap or tube handle member, which may take many forms, including an elongate member of rubber-like material 10 to 30 inches (0.25 to 0.76 meters) long and having a tether at its other end for attachment to the rider or the rider's clothing.

11 Claims, 4 Drawing Sheets

SKATEBOARD ACCESSORY TO ASSIST IN AIRBORNE MANEUVERS

This application is a continuation-in-part of U.S. patent application Ser. No. 07/665,421 filed Mar. 6, 1991, entitled "SKATEBOARD, ACCESSORY TO ASSIST IN AIRBORNE MANEUVERS" now abandoned.

BACKGROUND OF THE INVENTION

This invention relates to skateboards, and more particularly to a skateboard with an accessory to assist in keeping a rider in contact with and in control of the skateboard during airborne maneuvers and thereby provide increased control, balance and safety.

A skateboard rider normally has no good way to ensure remaining in contact with the skateboard once both the rider and board are airborne. This posed the obvious danger of injury from a faulty landing, as well as limiting the amount of balance and control that the rider has.

Moreover, in the "Ollie" maneuver, or jump from a surface, the skateboarder shifts his weight strongly to the rear of the board while using friction and his front foot to urge the front of the skateboard upward while staying in contact with it. Once airborne, the rider attempts to return the attitude of the board to level and to get his body's center of gravity back over the skateboard to return to a state of balance and control.

Some riders use the "Ollie" maneuver to jump curbs or just to jump, while much more advanced riders use it to jump over or jump onto much higher objects. Extremely advanced stunt artists even use an "Ollie" maneuver to jump onto a metal railing or bike rack, where they then perform additional maneuvers, such as balancing, sliding, teeter-tottering or "grinding", before sliding or jumping off the structure that they were on.

The main difficulty encountered in performing "Ollie" and other airborne maneuvers is that it is hard to control the skateboard and keep it in contact with the rider's feet. Skateboard riders have been known to experiment and improvise in their efforts to solve this problem. One approach is to crouch and grab one rail of the skateboard and hold onto it to keep it in contact with the feet while the rider performs his airborne maneuver in a crouch. However, it is difficult to jump while crouching, and holding the rail puts the rider off balance and exposes his fingers to injury during some types of maneuvers. If the jump is performed first and the bending to grab the rail second, any stabilization that is achieved only occurs late in the maneuver, after the hard part, i.e., gaining altitude, has already been accomplished.

Another approach that has been tried is for the skateboard rider to place a bicycle inner tube under his board, wrap one hand around the inner tube and, by pulling up on the inner tube as a jumping motion is initiated, try to hold the skateboard firmly against his feet as he is airborne.

While this approach is somewhat successful, it suffers from several drawbacks. If pressure is released, the inner tube can move about, become awkwardly displaced and even get tangled in the wheels of the skateboard and the rider's legs, thereby causing an accident. Moreover, maintaining constant pressure is inconvenient and impairs the rider's ability to perform many maneuvers. Even with constant pressure, the inner tube tends to slip around and not be in an optimum position for its intended purpose.

U.S. Pat. No. 4,732,400 to Santini for a "Scooter Board" discloses a skateboard-like vehicle with "A weight supporting, height adjustable and removable vertical upright assembly" centrally attached to the platform of the vehicle. This assembly includes a horizontal handle disposed transverse to the long axis of the vehicle along which the vehicle moves. U.S. Pat. No. 4,811,971 to Phillips for a "Ride-On Vehicle" discloses a somewhat similar vehicle with a vertical control stick of rigid material.

U.S. Pat. No. 4,179,134 to Atkinson for a "Removable Trainer Handle and Brake for Skateboard " discloses a removable handle and brake apparatus for attachment to the front end of a skate board with a clamp.

U.S. Pat. No. 4,289,325 to Whitacre for a "Skateboard" discloses a skateboard with an extra long front end to which is attached a rope and handle. The long front end and rope and handle permit easier control of turning for beginners and for low speed navigation of a slalom coarse.

U.S. Pat. No. 4,887,825 to Allen et al for a "Skateboard" discloses a skateboard enhanced with a retractable flexible cord passing through a hole in the center of the skateboard and attached to a retracting mechanism under the board. When fully extended, the retractable flexible cord can be used to hold the skateboard to the rider's feet while performing maneuvers.

There are, however, some disadvantages to the apparatus disclosed in the U.S. Pat. No. 4,887,825. One such disadvantage is that the handle remains on the top of the skateboard and in the way when it is not in use, limiting the type of maneuvers that can be performed. Also, the cord must remain fully extended to be ready for immediate use, and maintaining that pressure against the force of the retraction mechanism is inconvenient and also impairs the ability to perform many maneuvers. The retraction mechanism also adds to the weight of skateboard. With the high percentage of time that some advanced modern skateboarders spend doing jumps and other airborne maneuvers, adding any more weight than necessary is highly undesirable.

Another disadvantage of this approach is that the retraction mechanism and cord are disposed under the skateboard in a region between the two sets of wheels that the most advanced riders use when they have landed on top of other objects, such as the metal railings and bike racks mentioned above, and are engaged in balancing, sliding, teeter-tottering or "grinding" maneuvers.

What is desired is a readily disconnectable and light weight accessory for skateboards that provides the rider with a means of staying in contact and control of his skateboard while performing freestyle and airborne maneuvers, and yet does not protrude from, or take up space on, the bottom surface of the skateboard between the wheels where it interferes with balancing, sliding, teeter-tottering or other maneuvers atop objects, and which, when disconnected, does not take up any room on top of the skateboard either.

SUMMARY OF THE INVENTION

Accordingly, it is an object of the present invention to provide a readily disconnectable and light weight accessory for skateboards that gives the rider a means of staying in contact with and in control of his skateboard while performing freestyle and airborne maneuvers, and yet does not protrude from, or take up space on, the bottom surface of the skateboard between the wheels where it would interfere with balancing, sliding, teeter-tottering or other maneuvers atop suitable objects, and which, when disconnected, does not take up any room on top of the skateboard either.

One aspect of the present invention is an accessory for a skateboard, while another aspect of the invention is a skateboard equipped with such an accessory. Means are provided for attaching a flexible yet stretchable handle or one (or more than one) of a variety of such handles to a point on the skateboard in a readily disconnectable manner. The attachment means enables disconnection of the handle from on top of the skateboard and without the use of tools and does not more than minimally protrude from or take up space on the bottom surface of the skateboard between the two sets of wheels.

In a preferred embodiment of the invention, two thin discs of lightweight material connect together through a hole near the center of the skateboard and present one mating part of a quick disconnect connector to the upper side of the board. A second mating part of the opposite gender is attached to a stretchable handle, which may take many forms, including an elongate member of rubber-like material 10 to 30 inches (about 0.25 to about 0.75 meters) long and having a tether at its other end for attachment to the rider or rider's clothing.

As used herein, the word "stretchable" means that the handle is sufficiently elastic to allow a skateboard rider to stretch the handle so that the handle is extended by several inches using the force that can be exerted through one arm and without interfering with the rider's ability to shift position relative to the skateboard, while developing sufficient force to hold the skateboard in contact with the rider's feet when the wheels of the skateboard are not on the ground.

The subject matter of the present invention is particularly pointed out and distinctly claimed in the concluding portion of this specification. However, both the organization and method of operation, together with further advantages and objects thereof, may best be understood by reference to the following detailed description and accompanying drawings.

DETAILED DESCRIPTION

Figure 1:
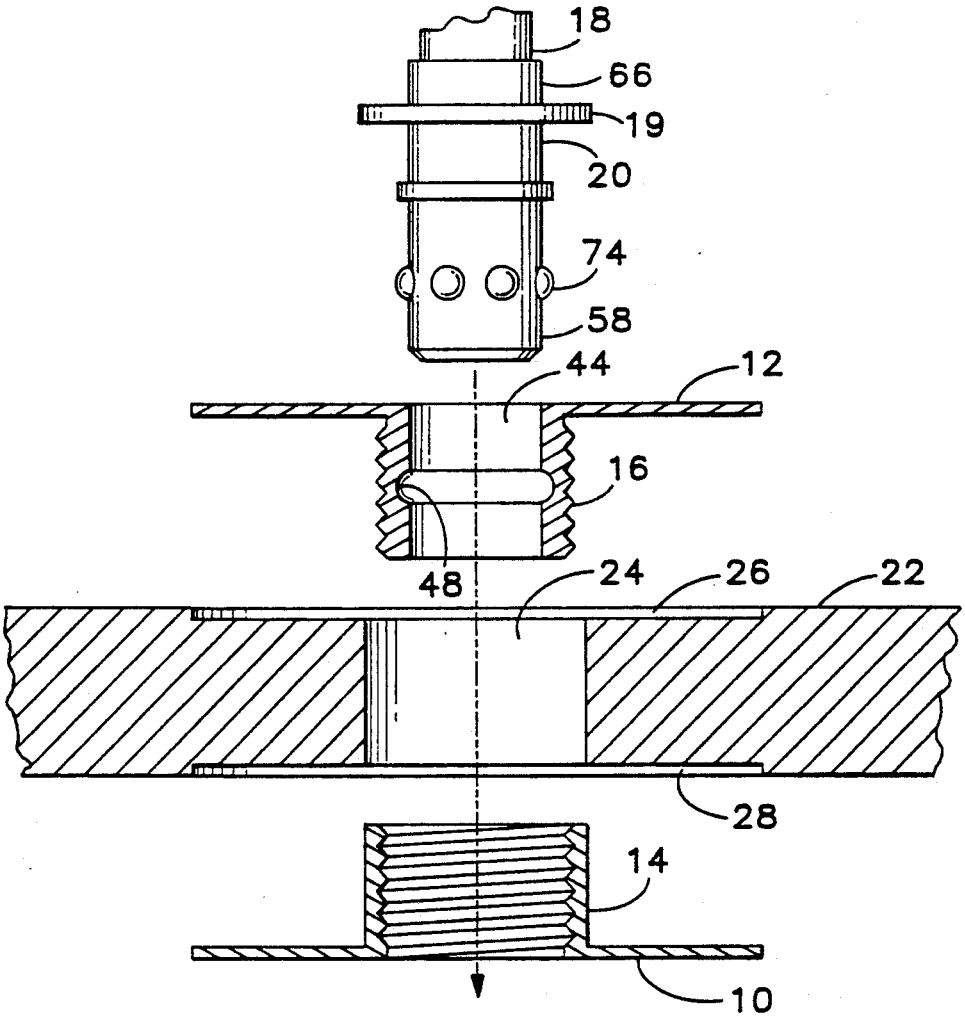
FIG. 1 is an exploded view of the fixture for attachment to the skateboard of the skateboard accessory of the present invention.

Referring to FIG. 1, a lower disc 10 has a lower disc extension 14 containing a female portion of a threadably mating connector. A central area of a skateboard 22 has had a hole 24 drilled in it to receive the lower disc extension 14. Ideally, an area 28 on the bottom surface of the skateboard 22 around the hole 24 has been countersunk to receive the lower disc 10, and an area 26 around the hole 24 on the other side of the skateboard 22 has also been countersunk to receive an upper disc 12. The upper disc 12 has an upper disc extension 16 containing a male portion of a threadably mating connector suitable for mating with female portion in the lower disc extension 14. While the illustrated embodiment employs disc extensions with threadably mating connectors, alternative structures may be employed. For example, the disc members may be snapped, riveted, crimped or screwed together. Further, non-disc shaped members may be employed. It suffices to have upper member 12 and lower member 14 be of such shape and size as to be low profile yet engage the skateboard body without pulling through the hole 24 during use.

To minimize the overall weight contribution of the accessory to the skateboard, the upper disc 12, the lower disc 10 and their extensions 16 and 14 are suitably manufactured from a high strength and low density alloy of a metal such as magnesium. Plastic, fiberglass or other suitable lightweight yet strong materials (or combination thereof) may also be employed.

The interior of the upper disc extension 16 contains a female portion of a quick release snap-in connector consisting of a chamber 44 and an annular groove 48. A handle member 18 is equipped at one end with a male portion 20 of the quick disconnect connector suitable for mating with the female portion within the upper disc extension 16. The male portion of the quick release snap-in connector 20 includes a projecting portion 58 having a number of balls 74 partially protruding from its surface in a circle of locations angularly distributed around its periphery.

The quick release snap-in connector is suitably constructed by adapting the principles disclosed in U.S. Pat. No. 4,144,794 to Silverman et al for a "Device for and Method of Removably Securing a Harness to a Musical Instrument", hereby incorporated by reference. The adaptation is to use a large version of the disclosed device and provide means on the button member (66) for attachment to the handle member 18 of the present invention.

Figure 2:
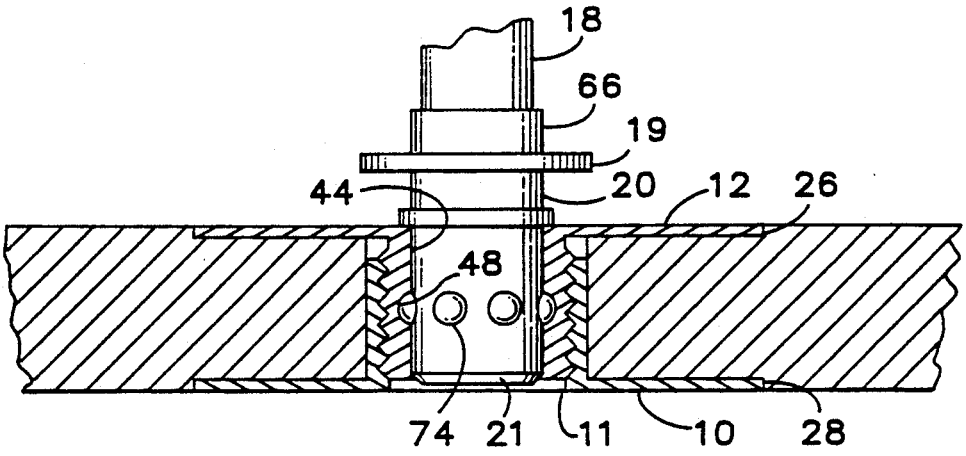
FIG. 2 is a side view of the fixture for attachment to the skateboard of the skateboard accessory of the present invention installed in a skateboard.

Referring now to FIG. 2 as well as FIG. 1, to use the accessory, the threadably mating connectors of the lower disc extension 14 and upper disc extension 16 are screwed together through the hole 24 in the board part 22 of the skateboard to produce a fixture for attachment 11 to the skateboard that is ready to receive the male portion 20 of the quick release snap-in connector.

The projecting portion 58 of the male portion 20 of the quick release snap-in connector is now inserted into chamber 44 by depressing button member 66. The button member 66 is depressed by applying force to the handle member 18 in the direction of motion indicated by the dashed line in FIG. 1. As explained in the U.S. Pat. No. 4,144,794, this will cause the balls 74 to recede into the surface of the projecting portion 58 when they encounter pressure from the sides of the chamber 44. After the projecting portion 58 is fully inserted into the chamber 44 and the pressure is released from handle member 18 and button member 66, the balls 74 will again be caused to protrude from the projecting portion 58 by a shaft connected to the button member 66. With the balls 74 forced to protrude into the annular groove 48, the projecting portion 58 of the male portion of the quick release snap-in connector is effectively retained in the chamber 44.

Referring to FIG. 2, to release the handle member 18 from the skateboard 22, the handle member 18 is used to apply pressure downward on the button member 66.

When the button member 66 is fully pressed into the male portion 20 of the quick release snap-in connector, the circular grip 19 may be used to pull projecting portion 58 from the chamber 44, since in these circumstances the balls 74 retract into the projecting portion 58 under the influence of the surface of the chamber 44 as the male portion 20 is withdrawn from the chamber 44. The quick release snap-in connector may also be provided with a locking device or safety type device, to prevent inadvertent release when the rider is performing maneuvers.

Referring now to FIGS. 3A–3H, the handle member 18 can assume many shapes and sizes. A long version 18*a* of handle member 18 is preferably about 10 to 30 inches (about 0.25 to about 0.75 meters) long, so that when extended vertically or almost vertically it nearly reaches the skateboard rider's thigh region when the rider is slightly crouched. This long version 18*a* of handle member 18 is longitudinally stretchable and is intended for use in a substantially upright or shallow crouching position, as shown in FIG. 4. Other shorter versions 18*b*, 18*c*, 18*d* and 18*e* of the handle member 18 are intended for use in a substantially crouched position.

The handle members 18 are preferably constructed of a strong, somewhat flexible yet quite stretchable material, such as rubber or other polymers or elastomeric materials, and may be equipped with a thicker region or grip 30 at the end removed from the skateboard. Version 18*c* of the handle member 18 differs from the others shown in that it is made of a strap of material rather than solid body of rubber or similar material. There is a trade-off between weight and strength in the material chosen for the handle member 18, since strength is required for safety and it is desirable to minimize the weight within the limitations of that safety constraint.

Figure 3A:
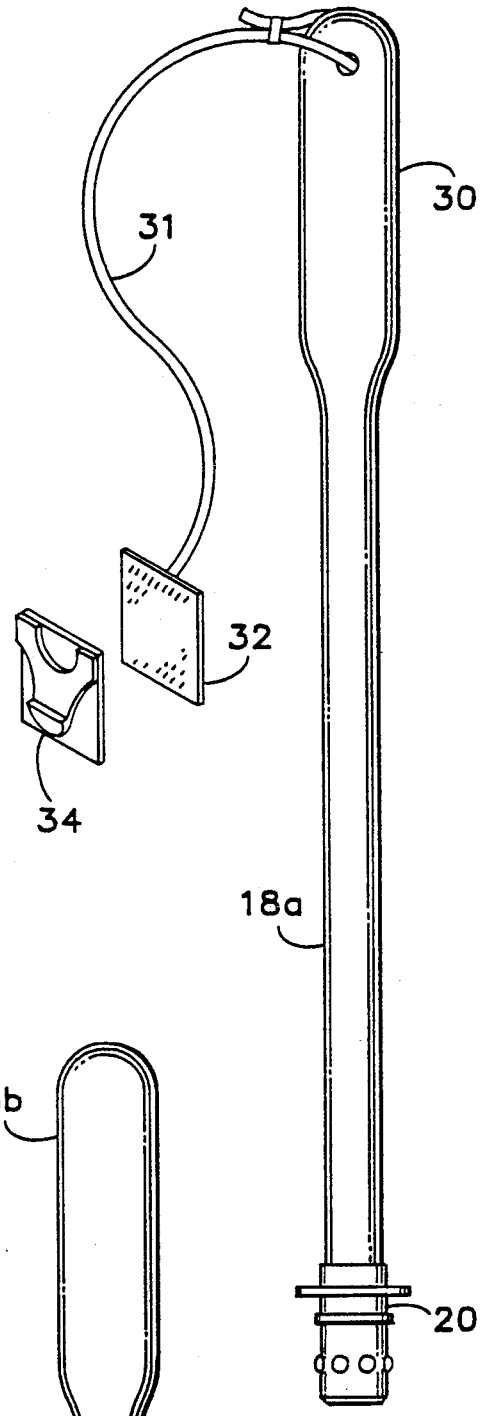
FIGS. 3A–3H are side views of a variety of handle members according to the present invention.
Figure 3C:
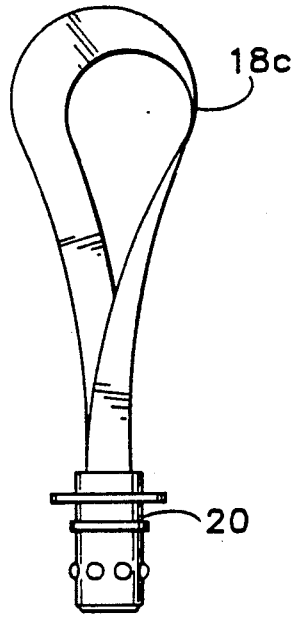
Figure 3D:
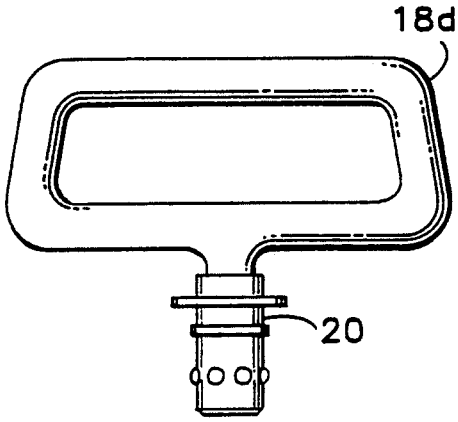
Figure 3B:
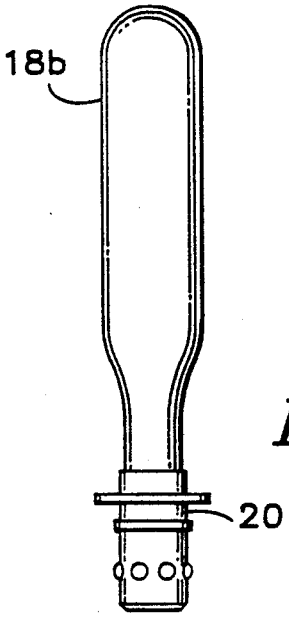
Figure 3E:
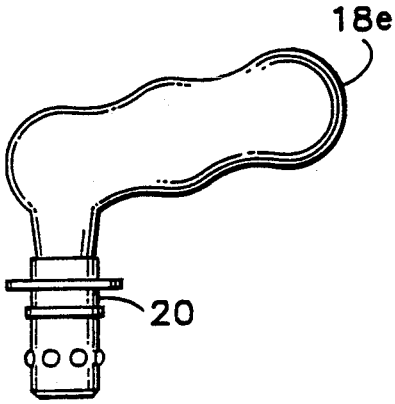
Figure 4:
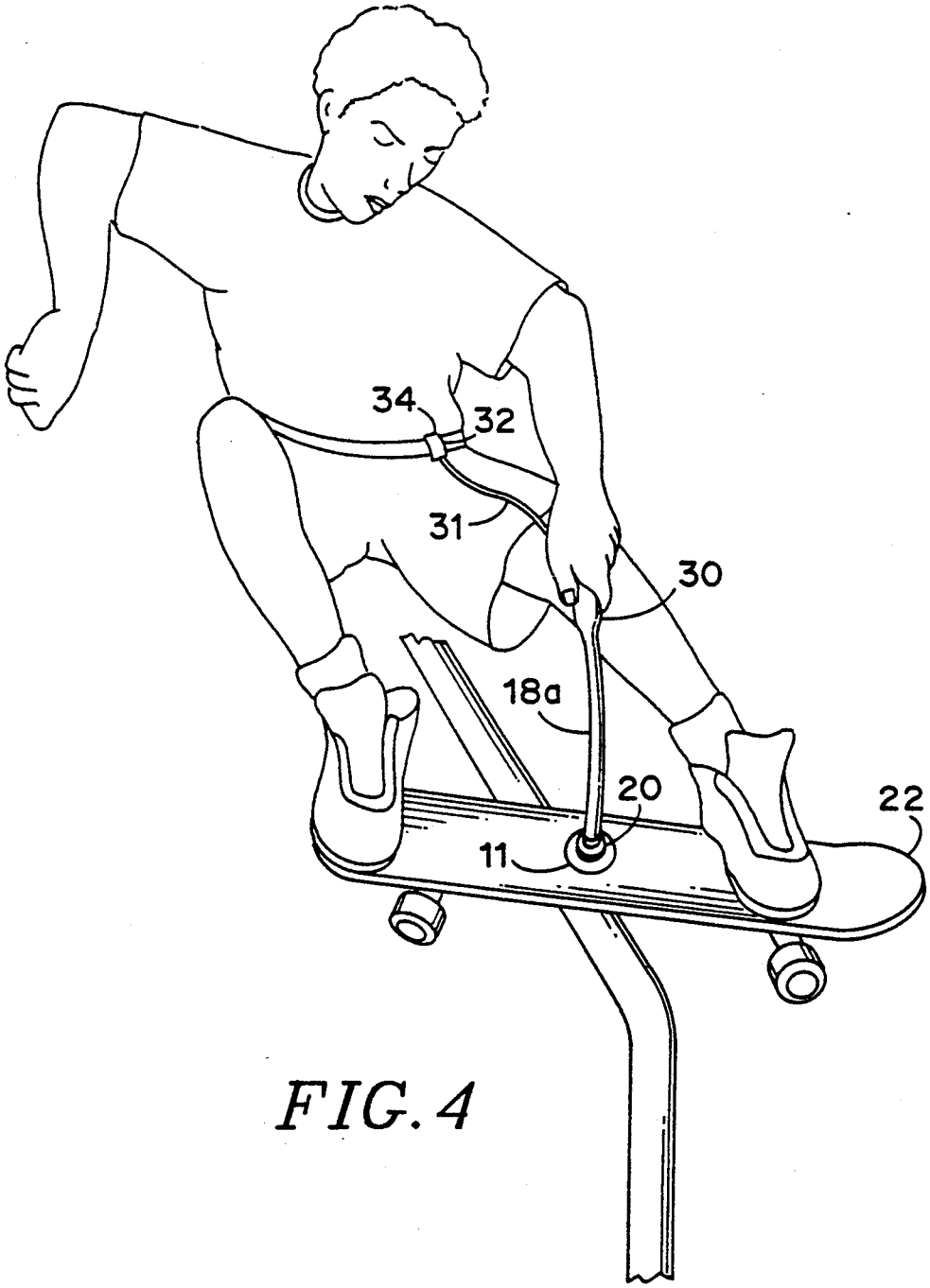
FIG. 4 is an action view of the use of the skateboard accessory of the present invention utilizing a long version of the handle member.

Referring now to FIGS. 3A and 4, a long version 18*a* of the stretchable member 18 is preferably equipped with a tether 31 for attachment to the rider's belt or such at the end distal from the skateboard. The tether 31 is suitably made of nylon and equipped with one element 32 of a hook and loop fastener (Velcro TM like) at the end removed from the handle member 18. The other element of the hook and loop fastener is mounted on a beltclip 34 for attachment to the rider's belt or such. Easy disconnection of the tether from the rider is desirable for safety reasons, so that a fast-moving out of control skateboard does not rebound into the rider.

Figure 3F:
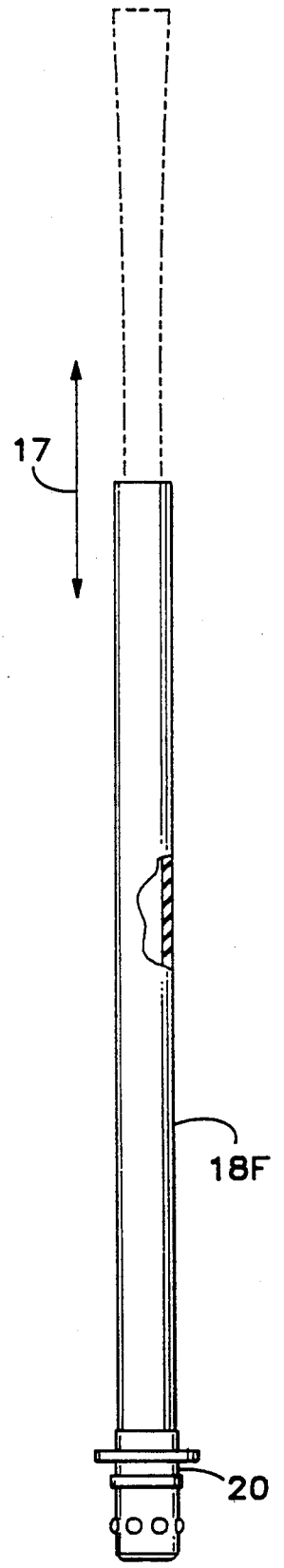
Figure 3G:
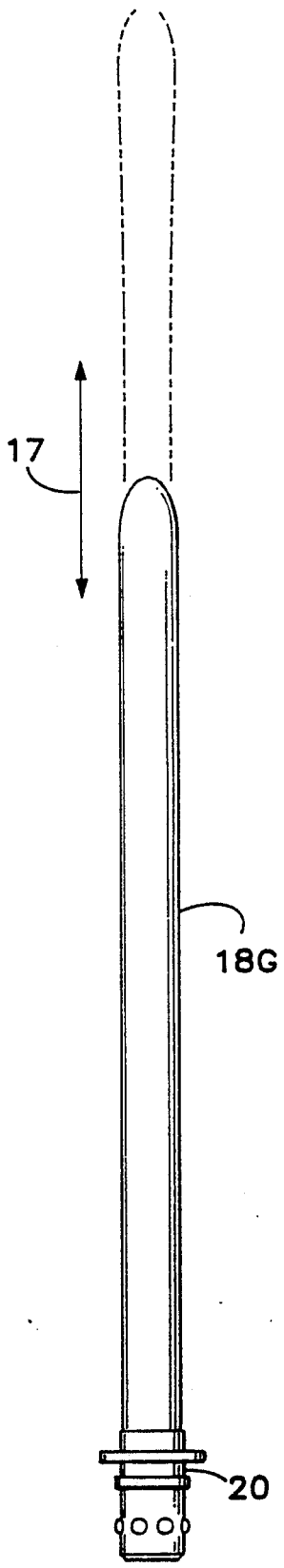
Figure 3H:
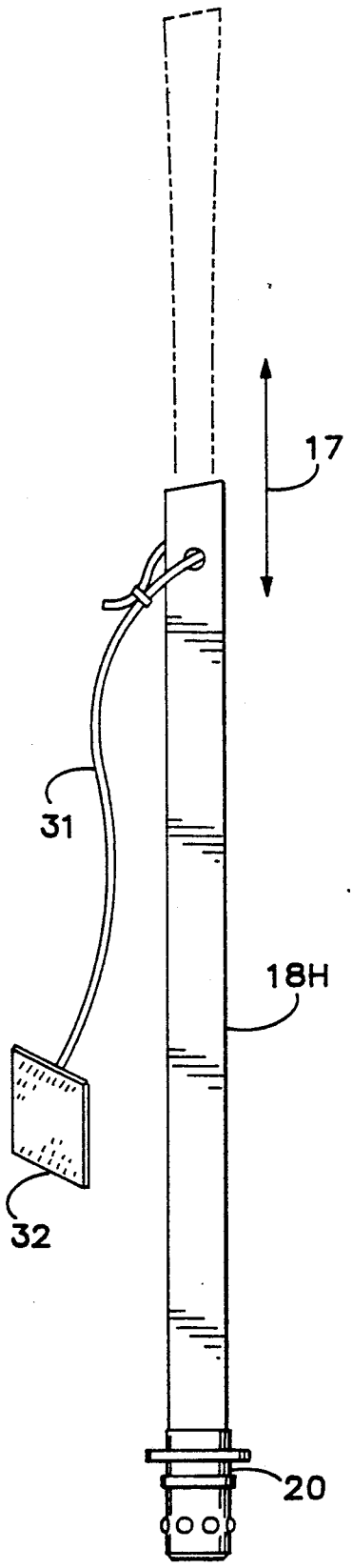

Referring now to FIGS. 3F–3H, further embodiments of handle members 18 of the present invention, the handles are preferably stretchable longitudinally along the axes defined by arrows 17. The handle members may comprise a hollow stretchable tube 18F, as illustrated in FIG. 3F or a solid stretchable strap 18G of FIG. 3G. The materials of which the handles are constructed may comprise an elastomeric tubing (e.g. rubber tubing) (18F) or an elastomeric strap material (18G) or some other suitable substance which is stretchable yet strong, so as to resist breaking when stretched. The straps 18F and 18G may be either quite flexible, such that they would fall limp if not supported by the rider, or be somewhat stiffer, having sufficient rigidity so as to hold their shape, standing upright when in a rest position, but still be flexible so as to allow substantial bending when the rider grips the handle, or to give way under the pressure of the rider's body or other object. Employing handle members which allow such bending reduces the likelihood of rider injury which could result if the rider fell against a rigid handle member during a crash or other mishap. While these handles are illustrated as circular shaped in cross section, any suitable shape may be employed.

Another embodiment of the handle member is strap 18H, illustrated in FIG. 3H. This strap may comprise a stretchable elastic fabric and, as in the case of strap 18A, may be equipped with a tether 31 for attachment to the rider's belt or the like at the end distal from the skateboard. The tether 31 is suitably made of nylon and equipped with one element 32 of a hook and loop fastener at the end removed from the handle member 18H. Straps 18F and 18G may also employ such a tether arrangement. The tether enables the rider to easily retrieve the handle (typically employed with the more flexible versions).

In addition to being readily stretchable, the handle members are suitably capable of extensive twisting without breaking or coming loose from the skateboard. Handles with varying degrees of stretchability may be provided, wherein some maneuvers would be suited to handles with a lesser extent of stretching, while other maneuvers would dictate greater stretching.

Whereas, the location of this accessory on the skateboard has thus far been shown and described as being near the center of the board, it might be desirable to locate it elsewhere for some types of maneuvers. Also, two or more handles may be used on the board at one time, attached to the board either at one location or at multiple locations, enabling the rider to perform elaborate maneuvers.

While a preferred embodiment of the present invention has been shown and described, it will be apparent to those skilled in the art that many changes and modifications may be made without departing from the invention in its broader aspects. The claims that follow are therefore intended to cover all such changes and modifications as fall within the true scope of the invention.

I claim:

1. An accessory for a skateboard, the accessory comprising:

handle means;

a readily disconnectable means of attachment for securing the handle to the skateboard having first and second mating parts;

a first disc adapted to overlay a bottom surface of the skateboard;

a second disc adapted to overlay a top surface of the skateboard; and threaded connector means comprising an inner threaded connector and an outer threaded connector adapted to be in threaded mutual engagement within a hole in the skateboard, one of said inner and outer connectors being attached to the first disc and the other of said inner and outer connectors being attached to the second disc, wherein the first mating part of the readily disconnectable means of attachment is disposed within the inner threaded connector, and wherein the second mating part of the readily disconnectable means of attachment is connected to the handle means.

2. An accessory according to claim 1, wherein the readily disconnectable means of attachment comprises a quick release snap-in connector.

3. An accessory according to claim 1, wherein said handle means comprises an elastomeric tube.

4. An accessory according to claim 1, wherein said handle means comprises an elastomeric strap.

5. An accessory according to claim 1, wherein said handle means comprises an elastic fabric.

6. An accessory according to claim 1, further comprising a tether attached to said handle means.

7. An accessory according to claim 1, wherein said readily disconnectable means of attachment further comprises safety means for preventing inadvertent disconnection.

8. An accessory according to claim 1, wherein the handle means is resilient, has sufficient stiffness to stand upright when unsupported, and sufficient pliability to give way under pressure of a rider's body, the handle means having a first terminal end and a second terminal end.

9. A skateboard comprising:

a board having a top surface and a bottom surface and a hole extending therethrough;

wheels affixed to the bottom surface of the board in a forward region and a rearward region;

fixture means attached to the board, the fixture means having a first mating part of a readily disconnectable means of attachment accessible from the top surface of the board, and the fixture means comprising a first disc overlaying the bottom surface of the board, a second disc overlaying the top surface of the board and threaded connector means disposed within the hole in the board, said threaded connector means comprising an inner threaded connector and an outer threaded connector in threaded mutual engagement within the hole in the board, one of said inner and outer connectors being attached to the first disc and the other of said inner and outer connectors being attached to the second disc, wherein the first mating part of the readily disconnectable means of attachment is disposed within the inner threaded connector, whereby the fixture means only minimally protrudes from or takes up space on the board; and handle means having a second mating part of the readily disconnectable means of attachment, the handle means attaching to the fixture means when the first and second mating parts of the readily disconnectable means of attachment are engaged.

10. A skateboard according to claim 9, wherein the readily disconnectable means of attachment comprises a quick release snap-in connector.

11. A skateboard according to claim 4, wherein the handle means is resilient, has sufficient stiffness to stand upright when unsupported, and sufficient pliability to give way under pressure of a rider's body, the handle means having a first terminal end and a second terminal end.

* * * * *